US011313625B2

(12) United States Patent
Sun

(10) Patent No.: US 11,313,625 B2
(45) Date of Patent: Apr. 26, 2022

(54) INTENSIFIED CASSETTE-TYPE HEAT DISSIPATION MODULE

(71) Applicant: Yuan-Hsin Sun, Miaoli County (TW)

(72) Inventor: Yuan-Hsin Sun, Miaoli County (TW)

( * ) Notice: Subject to any disclaimer, the term of this patent is extended or adjusted under 35 U.S.C. 154(b) by 218 days.

(21) Appl. No.: 16/715,307

(22) Filed: Dec. 16, 2019

(65) Prior Publication Data

US 2021/0180869 A1 Jun. 17, 2021

(51) Int. Cl.

| | |
|---|---|
| ***F28D 15/02*** | (2006.01) |
| ***F28D 7/00*** | (2006.01) |
| *F28F 9/02* | (2006.01) |
| *F28F 1/24* | (2006.01) |

(52) U.S. Cl.

CPC ..... *F28D 15/0275* (2013.01); *F28D 7/0016* (2013.01); *F28D 15/0266* (2013.01); *F28F 1/24* (2013.01); *F28F 2009/0287* (2013.01); *F28F 2009/0292* (2013.01); *F28F 2270/00* (2013.01)

(58) Field of Classification Search

CPC ..... F28D 15/0266; F28D 15/0275; F28D 2021/0031; F28D 2021/0029; F28F 2270/00

See application file for complete search history.

(56) References Cited

U.S. PATENT DOCUMENTS 2,947,150 A * 8/1960 Roeder, Jr. ..... F25B 21/02 62/3.6
7,746,641 B2 * 6/2010 Sun ..... G06F 1/20 361/700
2003/0029174 A1 * 2/2003 Lee ..... F28D 15/0275 62/3.6
2003/0056936 A1 * 3/2003 Lindemuth ..... F25B 23/006 165/45
2006/0262505 A1 * 11/2006 Cheng ..... G06F 1/20 361/700
2007/0102146 A1 * 5/2007 Scott ..... F28D 15/0266 165/177
2009/0310307 A1 * 12/2009 Lin ..... H01L 23/427 361/700
2011/0179806 A1 * 7/2011 Ipposhi ..... F28D 15/0266 62/3.3
2012/0211204 A1 * 8/2012 Agonafer ..... F28D 15/0266 165/104.31
2013/0199591 A1 * 8/2013 Khan ..... H01L 35/30 136/206
2013/0291555 A1 * 11/2013 Edwards ..... F25B 21/04 62/3.2
2013/0291564 A1 * 11/2013 Ghoshal ..... F28F 1/325 62/3.6

(Continued)

*Primary Examiner* — Devon Russell

(74) *Attorney, Agent, or Firm* — Muncy, Geissler, Olds & Lowe, P.C.

(57) ABSTRACT

An intensified cassette-type heat dissipation module includes a heat sink, an amplifying loop heat pipe, a condensing block and an object of application. The heat sink is provided with an embedding space for disposing plural refrigeration chips and the condensing block. The heat sink utilizes the amplifying loop heat pipe to dissipate heat. A cold-surface loop heat pipe affixes itself to the condensing block to transmit a cold source to the object of application. The refrigeration chips transmit energy to the condensing block, and the cold-surface loop heat pipe supplies energy required by the object of application.

11 Claims, 13 Drawing Sheets

(56) References Cited

U.S. PATENT DOCUMENTS

| | | | | |
|---|---|---|---|---|
| 2015/0075184 | A1* | 3/2015 | Edwards | F28D 15/0266 62/3.2 |
| 2019/0203983 | A1* | 7/2019 | Jeon | H05K 7/20318 |
| 2019/0226768 | A1* | 7/2019 | Kao | F28D 15/0275 |
| 2019/0226769 | A1* | 7/2019 | Kao | F28D 15/04 |

* cited by examiner

INTENSIFIED CASSETTE-TYPE HEAT DISSIPATION MODULE

BACKGROUND OF THE INVENTION a) Field of the Invention

The present invention relates to an intensified cassette-type heat dissipation module, and more particularly to an intensified cassette-type heat dissipation module, which includes a heat sink, an amplifying loop heat pipe and a condensing block. The heat sink is provided with an embedding space for attachment of plural refrigeration chips and for latching of the condensing block. The amplifying loop heat pipe is utilized to dissipate heat from the refrigeration chips. The condensing block is employed to transmit cold sources of the refrigeration chips to an object of application for supplying energy required by the object of application.

b) Description of the Prior Art

It is known that a refrigeration chip can conduct cooling or heating by only inputting electric current, which is simple in operation and easy in maintenance. As there are no mechanical parts, no noise, and no refrigerant that the concept of environmental protection is complied with, the market of refrigeration chip grows extremely fast. The refrigeration chip is primarily applied to precision temperature control in optical communications, heat cycles of process equipment in the areas of biomedicine and semiconductors, consumer appliances, central processing units (CPUs), electrical appliances, computers, power source control, and instruments, etc. As high temperature produced in operation will affect the lifetimes of electronic parts in the equipment described above, the refrigeration chip is conventionally cooled down by cooling plates and cooling fans. However, there is no significant and quick breakthrough in the heat dissipation efficiency now. The heat dissipation technology includes the common cooling plates, fans, heat pipes and water-cooling systems. Most of them use the heat conduction properties of materials themselves or the latent heat absorbed in the phase change of working fluid to remove the heat from electronic parts. Heat is basically transmitted from a high temperature end to a low temperature end or is transmitted actively that the heat is transmitted from the low temperature end to the high temperature end continuously; the refrigeration chip belongs to the active refrigeration. In comparison with a compressor system, the energy cost-effectiveness of refrigeration chip is inferior to that of the compressor system. However, in terms of small size, no movable parts, low noise, low weight and precision temperature control, the refrigeration chip has a unique advantage. In the area of people's livelihood, such as a small-sized refrigerator or a red wine cabinet without vibration, the refrigeration chip has always been used extensively. On the other hand, in the application of industry and science, as the refrigeration chip is easy to control temperature, it is especially applicable to biomedical instruments, water chillers, cryogenic instruments and cryometers that require the heat cycles of repeated change in temperature. In the biomedical area, it requires a long temperature cycle under a high heat flux to duplicate DNA, and it is specifically suitable for the refrigeration chip. On the other hand, in the semi-conductor industry, the refrigeration chip has already been massively introduced into process temperature control of semi-conductor wafers.

The conventional heat dissipation module used in the refrigeration chip only includes a heat pipe, a vapor chamber, a single-unit loop pipe or a loop heat pipe that penetrates into all kinds of radiator. The shortcomings of the conventional heat dissipation module are that:

1. Currently, the conventional heat pipe, vapor chamber, single-unit loop pipe or loop heat pipe is used for energy transmission, but the transmission speed is slow, the functioning efficiency is not high and the quantity of heat transmission is small.
2. The contact between the refrigeration chip and a thermal block is often positioned by studs, which is slow and inconvenience in assembling.
3. The radiator is mostly a cooling fin, which is limited in the heat dissipation efficiency.
4. For now, all kinds of heat pipes and heat sinks are assembled individually, which can lose the heat dissipation efficiency easily.
5. Currently, all kinds of heat sinks are applied to planar heat sources and therefore they cannot cope with three-dimensional 2.5D or 3D heat sources in the future (such as a heightened and thickened CPU, wherein a top surface and four side surfaces need cooling).

SUMMARY OF THE INVENTION

The heat dissipation efficiency of an existing heat dissipation module that is used to cool apparatuses or is used in a refrigeration chip is not improved. Therefore, when the heat dissipation module is applied to precision temperature control in optical communications, heat cycles of process equipment in the areas of biomedicine and semi-conductors, consumer appliances, CPUs, electrical appliances, computers, power source control and instruments, the lifetimes of electronic parts and working efficiencies thereof will be affected by high temperature.

Accordingly, the present invention discloses an intensified cassette-type heat dissipation module, comprising a heat sink, an amplifying loop heat pipe, a condensing block and an object of application.

The heat sink is provided with two opposite hot-surface heat sink blocks. Top ends of the two hot-surface heat sink blocks are a heat insulating cover, and a hot-surface loop heat pipe affixes itself to the hot-surface heat sink blocks via penetration. A concaved embedding space is formed between the two hot-surface heat sink blocks and the heat insulating cover, and two sides in the embedding space are provided respectively with plural refrigeration chips that are attached on the inner surfaces of the hot-surface heat sink blocks.

The amplifying loop heat pipe is provided with at least a hot-surface loop heat pipe, at least a first evaporating pipe, a secondary loop heat pipe, a first cooling fin and a second cooling fin. The hot-surface loop heat pipe crosses the hot-surface heat sink blocks and then penetrates into the first evaporating pipe and the second cooling fin. The first evaporating pipe is introduced from two ends of the secondary loop heat pipe, an upper side of the first cooling fin is provided with fans, and a side of the secondary cooling fin is provided with fans, as well.

The condensing block and the plural refrigeration chips are disposed in the embedding space together, and a cold-surface loop heat pipe affixes itself to the condensing block via penetration.

The object of application is combined with the condensing block, allowing the refrigeration chips to transmit energy to the condensing block and the cold-surface loop heat pipe to supply energy required by the object of application.

The primary object of the present invention is to provide an intensified cassette-type heat dissipation module, wherein the heat sink is provided with the embedding space for attachment of refrigeration chips and for latching of the condensing block, allowing the condensing block to be latched and dismantled quickly and conveniently.

Another object of the present invention is to provide an intensified cassette-type heat dissipation module, wherein the amplifying loop heat pipe is utilized to dissipate heat from the refrigeration chips, so that the refrigeration chips can be cooled down quickly and effectively.

Still another object of the present invention is to provide an intensified cassette-type heat dissipation module, wherein the condensing block is utilized to transmit the cold sources of the refrigeration chips, so that the refrigeration chips can freeze quickly or the cold sources can be transmitted effectively. The refrigeration chips can be applied to all kinds of objects of application to supply energy required by the objects of application or to decrease temperature of the objects of application.

Yet still another object of the present invention is to provide an intensified cassette-type heat dissipation module, wherein the heat sink is provided with the embedding space for attachment and latching of a three-dimensional CPU (such as a heightened and thickened CPU) that the CPU can be cooled down quickly and effectively.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
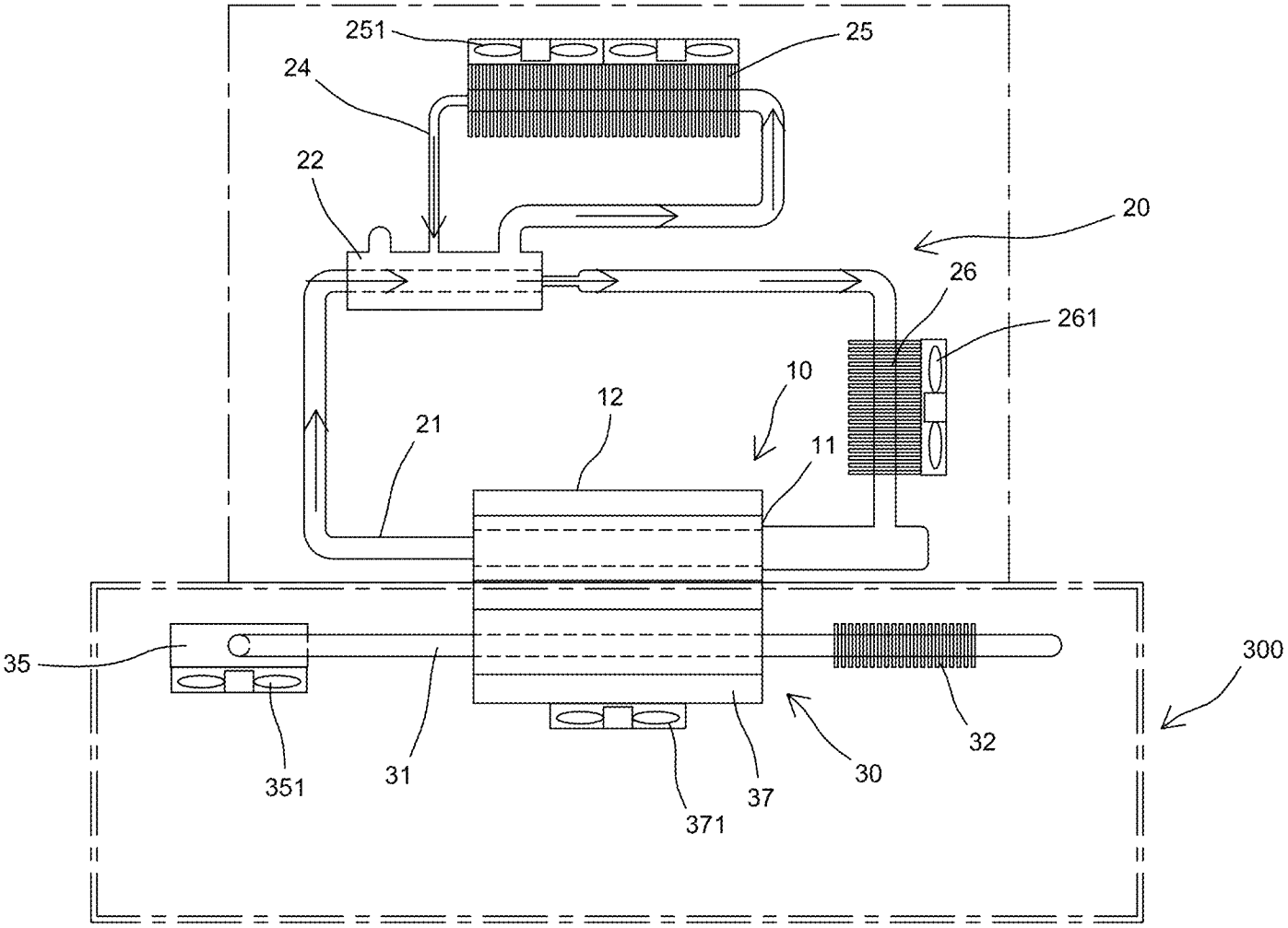
FIG. 1 shows a front planar view of a first embodiment of the present invention.
Figure 2:
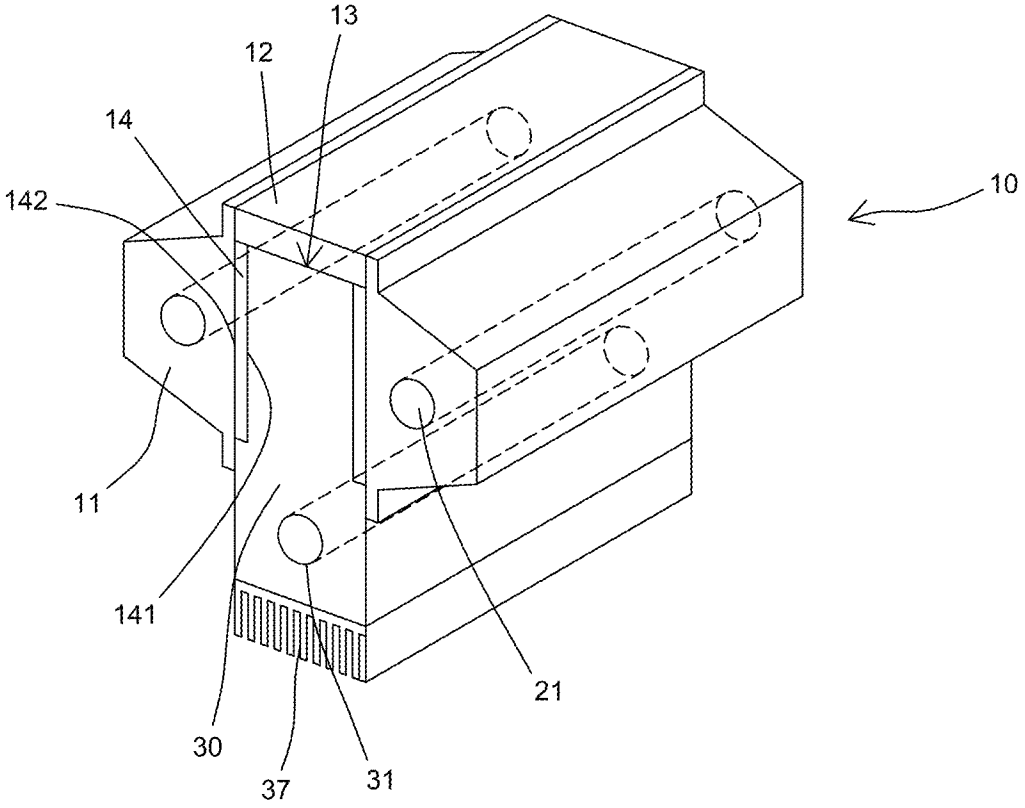
FIG. 2 shows a three-dimensional assembly view of a heat sink, two refrigeration chips and a condensing block, according to the first embodiment of the present invention.
Figure 3:
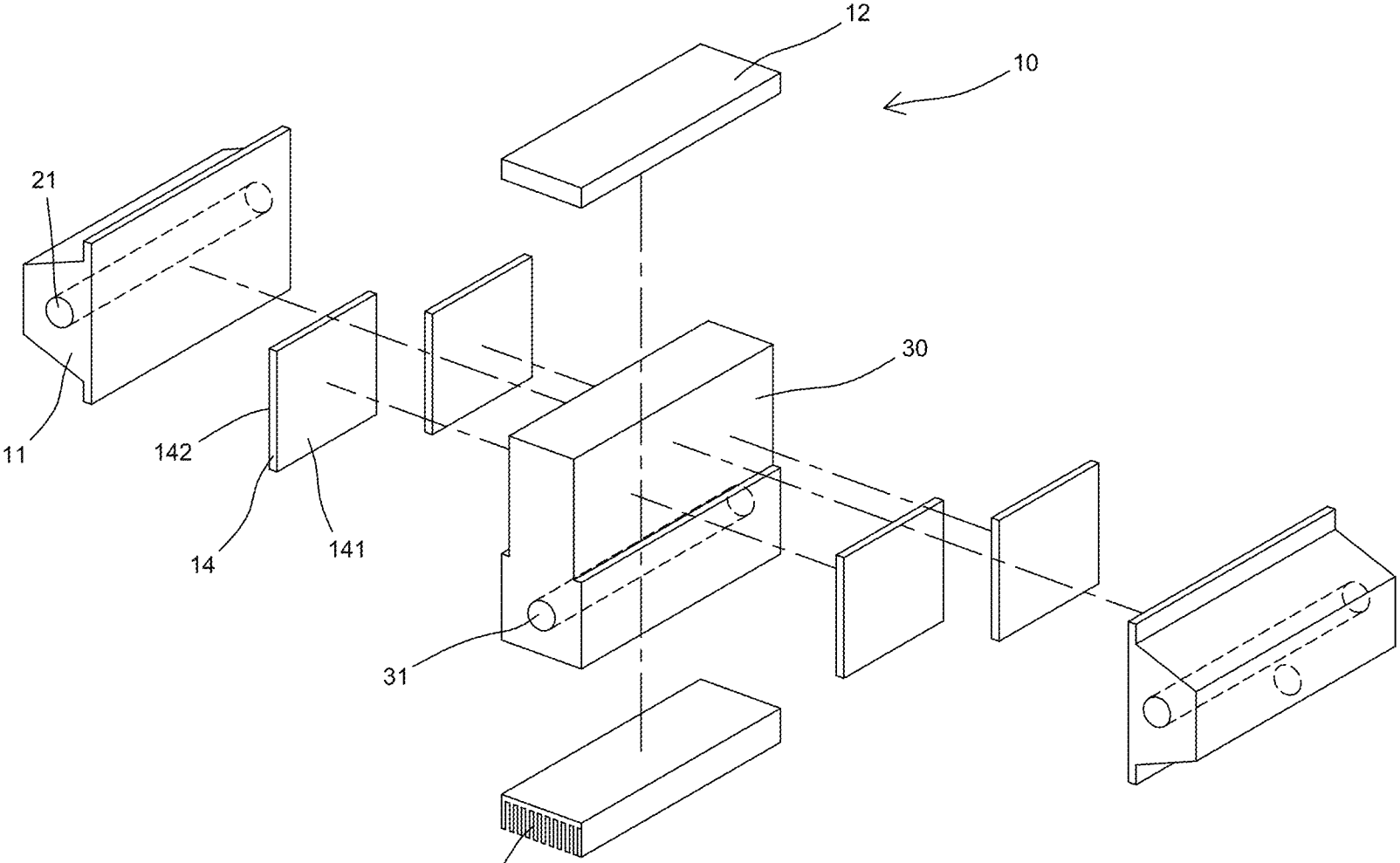
FIG. 3 shows a three-dimensional exploded view of the heat sink, the two refrigeration chips and the condensing block, according to the first embodiment of the present invention.

Referring to FIGS. 1 to 5, the present invention discloses an intensified cassette-type heat dissipation module, comprising a heat sink 10, an amplifying loop heat pipe 20, a condensing block 30 and an object of application 300. The heat sink 10 is provided with two opposite hot-surface heat sink blocks 11, top ends of the two hot-surface heat sink blocks 11 are provided with a heat insulating cover 12, and studs (not shown in the drawings) can be used on top ends at two sides of the hot-surface heat sink blocks 11 to position the heat insulating cover 12; otherwise, the two hot-surface heat sink blocks 11 can be formed integrally with the heat insulating cover 12. A hot-surface loop heat pipe 21 affix themselves to the hot-surface heat sink blocks 11 via penetration, and a concaved embedding space 13 in an inverted-U shape is formed between the two hot-surface heat sink blocks 11. Two sides in the embedding space 13 are provided respectively with two refrigeration chips 14, each refrigeration chip 14 is provided with a refrigeration surface 141 and a heat dissipation surface 142, and the heat dissipation surface 142 is attached on an inner surface of the hot-surface heat sink block 11. The condensing block 30 is disposed in the embedding space 13. A cold-surface loop heat pipe 31 affixes itself to the condensing block 30 via penetration. The refrigeration surface 141 is attached on an outer surface of the condensing block 30. The amplifying loop heat pipe 20 is provided with at least one hot-surface loop heat pipe 21 (pure water working fluid), at least a first evaporating pipe 22 (a capillary evaporator using low-temperature working fluid, normal-temperature working fluid, methanol or aqua ammonia), a secondary loop heat pipe 24, a first cooling fin 25 and a second cooling fin 26. The hot-surface loop heat pipe 21 crosses the hot-surface heat sink blocks 11 and then penetrates into the first evaporating pipe 22 and the second cooling fin 26. The secondary loop heat pipe 24 enters into the first cooling fin 25, and the first evaporating pipe 22 provides for introduction of two ends of the secondary loop heat pipe 24. An upper side of the first cooling fin 25 is provided with fans 251, and a side of the second cooling fin 26 is provided with fans 261, as well. The object of application 300 is combined with the condensing block 30, allowing the refrigeration chips 14 to transmit energy to the condensing block 30, and the cold-surface loop heat pipe 31 to supply energy required by the object of application 300; wherein, the object of application 300 is implemented as that the cold-surface loop heat pipe 31 crosses a fourth cooling fin 32, a fifth cooling fin 35 and a refrigerant tube 36, a lower side of the fifth cooling fin 35 is provided with fans 351, a lower side of the condensing block 30 is provided with a third cooling fin 37, and a lower side of the third cooling fin 37 is provided with fans 371. Along the paths that the hot-surface loop heat pipe 21 and the secondary loop heat pipe 24 go through respectively, the pipe diameters can be large or small, which determines the direction of convection and the interval of time of staying.

Figure 4:
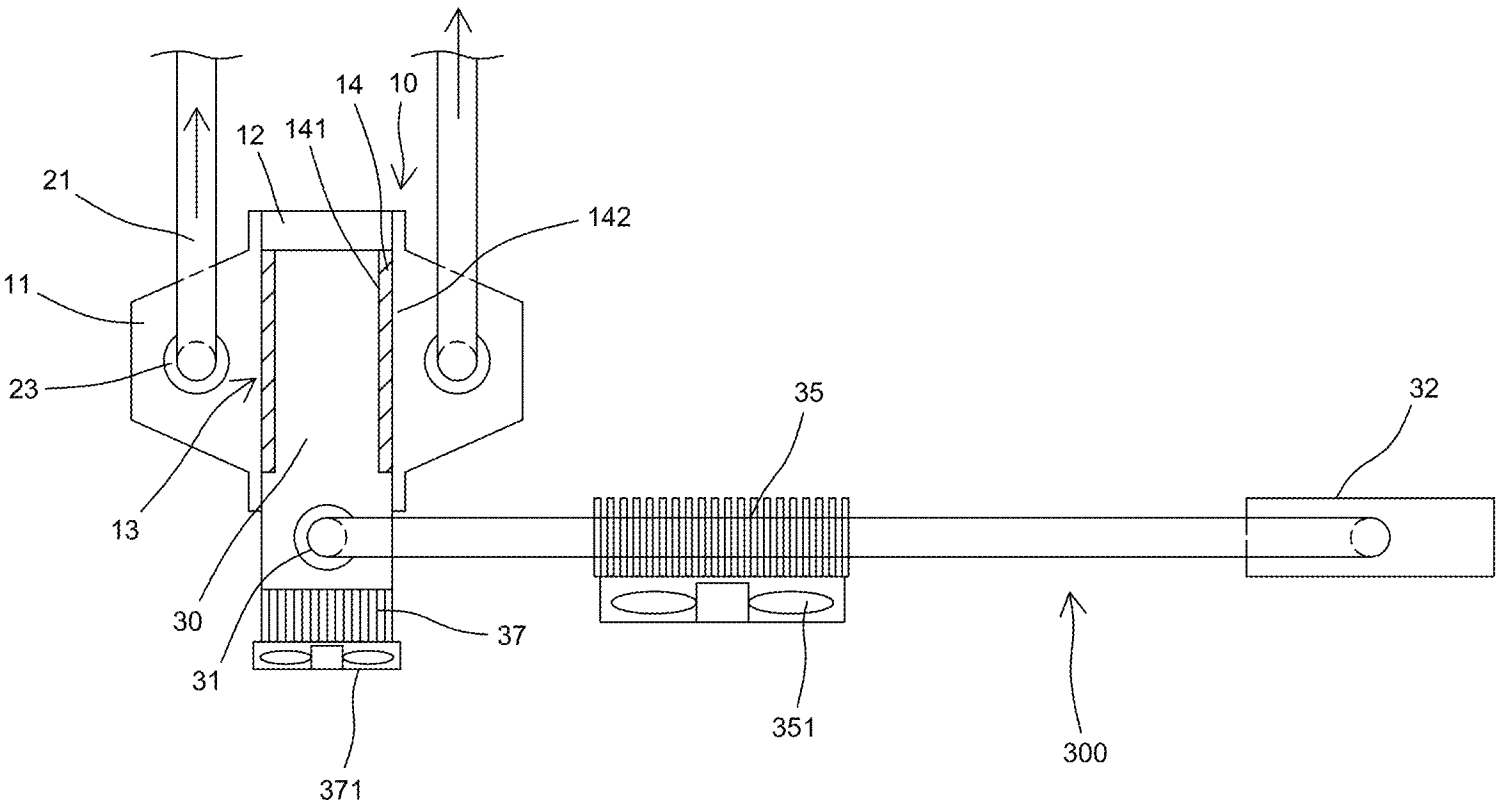
FIG. 4 shows a left planar view of the first embodiment of the present invention.

According to the assembly of abovementioned structures, in a first embodiment, the refrigeration surface 141 of the refrigeration chip 14 is attached on the condensing block 30, and then the condensing block 30 is disposed in the embedding space 13 of the heat sink 10 to be positioned. In one way, the embedding space 13 results in clamping force to the condensing block 30. On the other hand, when the refrigeration surface 141 results in a cold source, the cold source will condense to position the condensing block 30. If the condensing block 30 is to be dismantled from the embedding space 13 of the heat sink 10, a user only needs to exchange the positive electrode with the negative electrode of current, and exchange the cold source on the cold surface with the heat source on the hot surface of the refrigeration chip 14, then the condensing block 30 and the refrigeration chip 14 will defreeze naturally, so that the condensing block 30 can be dismantled successfully. The heat source resulted from the heat dissipation surface 142 of the refrigeration chip 14 passes through the hot-surface heat sink blocks 11 to the hot-surface loop heat pipe 21, and then goes through the first evaporating pipe 22 (as shown in the arrow on FIG. 1). When passing through the first evaporating pipe 22 (the hot-surface loop heat pipe 21 only passes through the first evaporating pipe 22, and the working fluid in each pipe does not mix with each other), the working fluid in the first evaporating pipe 22 vaporizes by the increase in temperature, and then enters from the secondary loop heat pipe 24 on the tail end into the first cooling fin 25 for dissipating the heat. After that, the working fluid circulates to the front end of the secondary loop heat pipe 24 and re-enters into the first evaporating pipe 22. When coming out of the hot-surface loop heat pipe 21 of the first evaporating pipe 22, the working fluid flows to the second cooling fin 26 and circulates into the hot-surface heat sink blocks 11. Accordingly, the working fluid circulates repeatedly, conducting and dissipating the heat source resulted from the heat dissipation surface 142 of the refrigeration chip 14 through the first evaporating pipe 22, the first cooling fin 25 and the second cooling fin 26, and then dissipating a heat flow quickly and effectively through the fans 251, 261 continuously. On the other hand, the cold source resulted from the refrigeration surface 141 of the refrigeration chip 14 passes through the condensing block 30 to the cold-surface loop heat pipe 31 (as shown in the arrow on FIG. 5), crosses the refrigerant tube 36 and circulates to the condensing block 30 through the fifth cooling fin 35 and the fourth cooling fin 32. Accordingly, the working fluid circulates repeatedly, transmitting the cold source resulted from the refrigeration surface 141 of the refrigeration chip 14 through the fifth cooling fin 35, the fourth cooling fin 32 and the third cooling fin 37 (as shown in FIG. 4 and FIG. 5), and dissipating a cold flow for refrigeration by the fans 351, 371.

Figure 5:
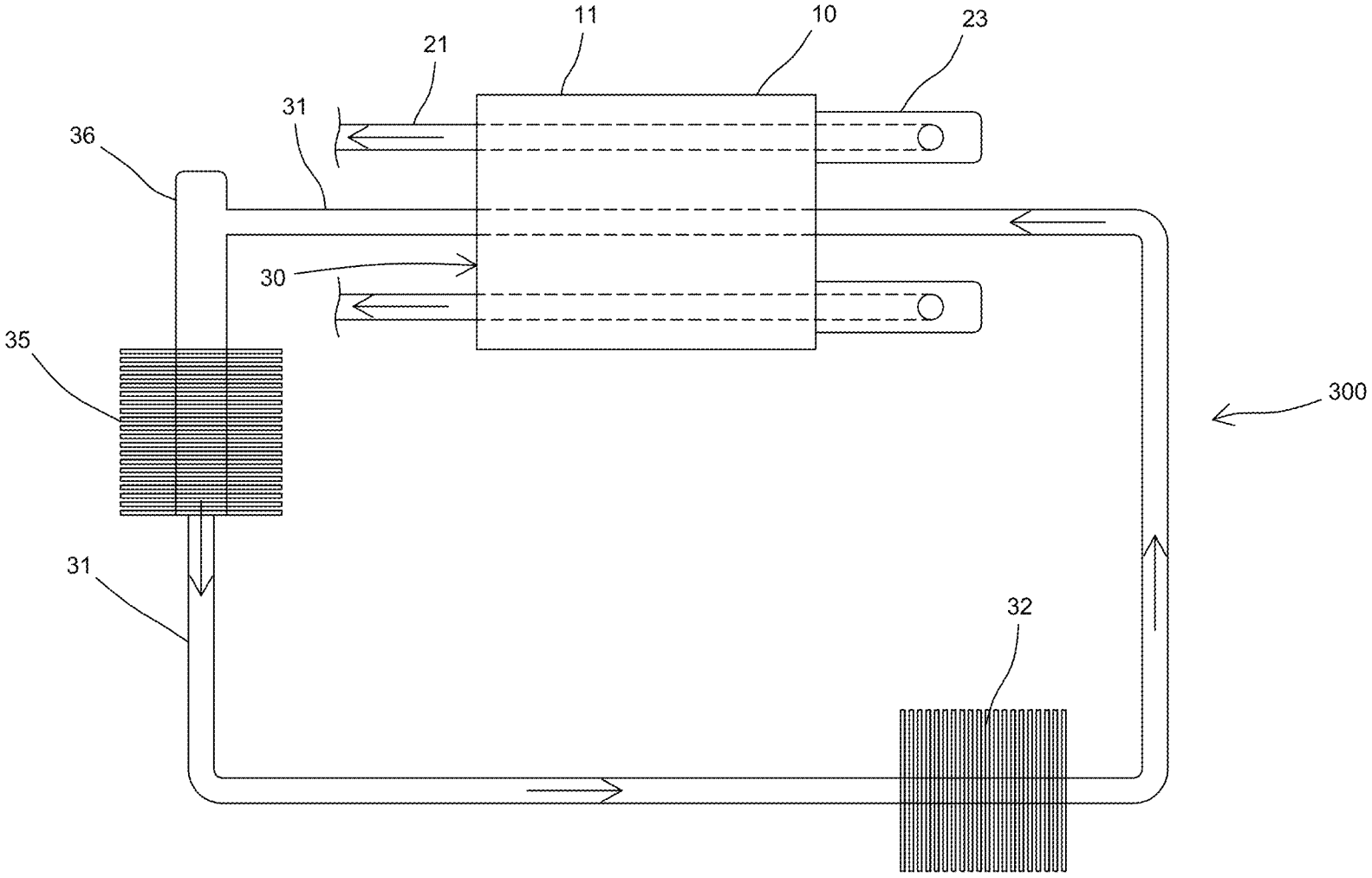
FIG. 5 shows a top planar view of the first embodiment of the present invention.
Figure 6:
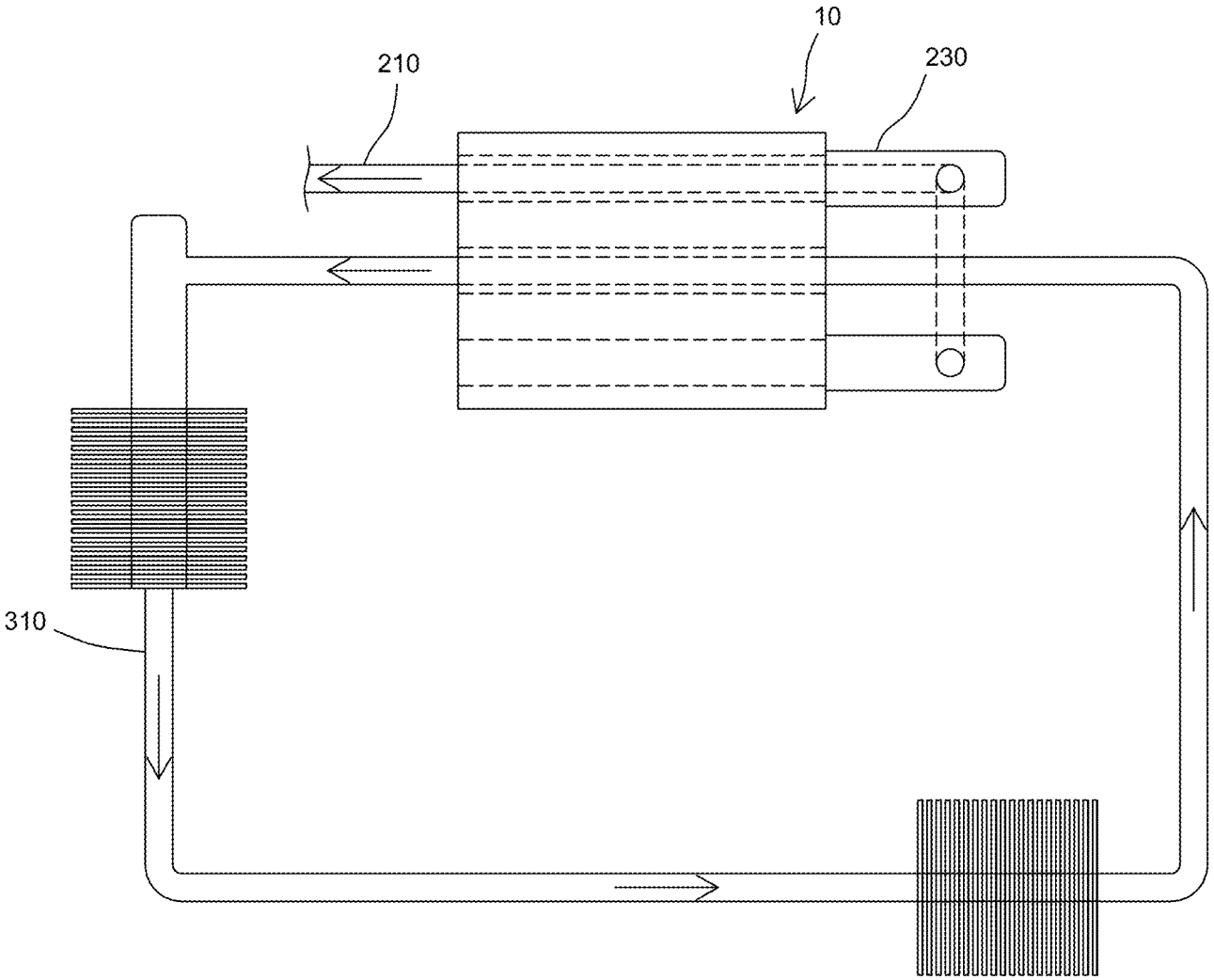
FIG. 6 shows a top planar view of a second embodiment of the present invention.
Figure 7:
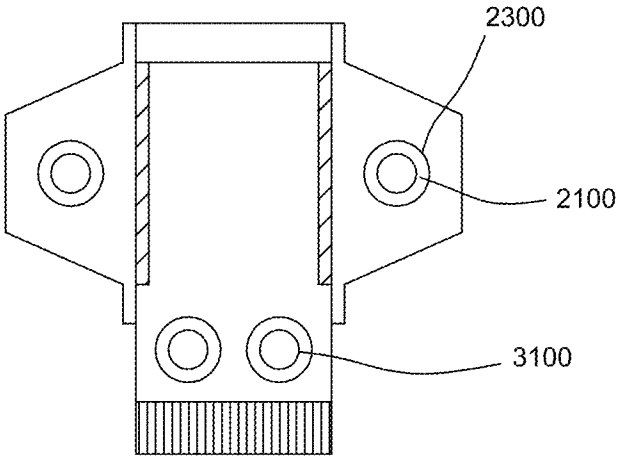
FIG. 7 shows a cutaway view of the heat sink, according to a third embodiment of the present invention.

As shown in FIG. 5, the first embodiment is provided with two sets of hot-surface loop heat pipes 21 that are independent of each other without being interconnected; whereas, the cold-surface loop heat pipe 31 is a single pipe unit. A second embodiment is shown in FIG. 6. There is one set of hot-surface loop heat pipe 210, but there are two hot-surface loop heat pipes 210 in the heat sink 10. The two hot-surface loop heat pipes 210 are interconnected at tail ends thereof; whereas, the cold-surface loop heat pipe 310 is a single pipe unit. On the other hand, as shown in FIG. 7, a third embodiment is provided with two sets of hot-surface loop heat pipes 2100 and also two sets of cold-surface loop heat pipes 3100.

Figure 8:
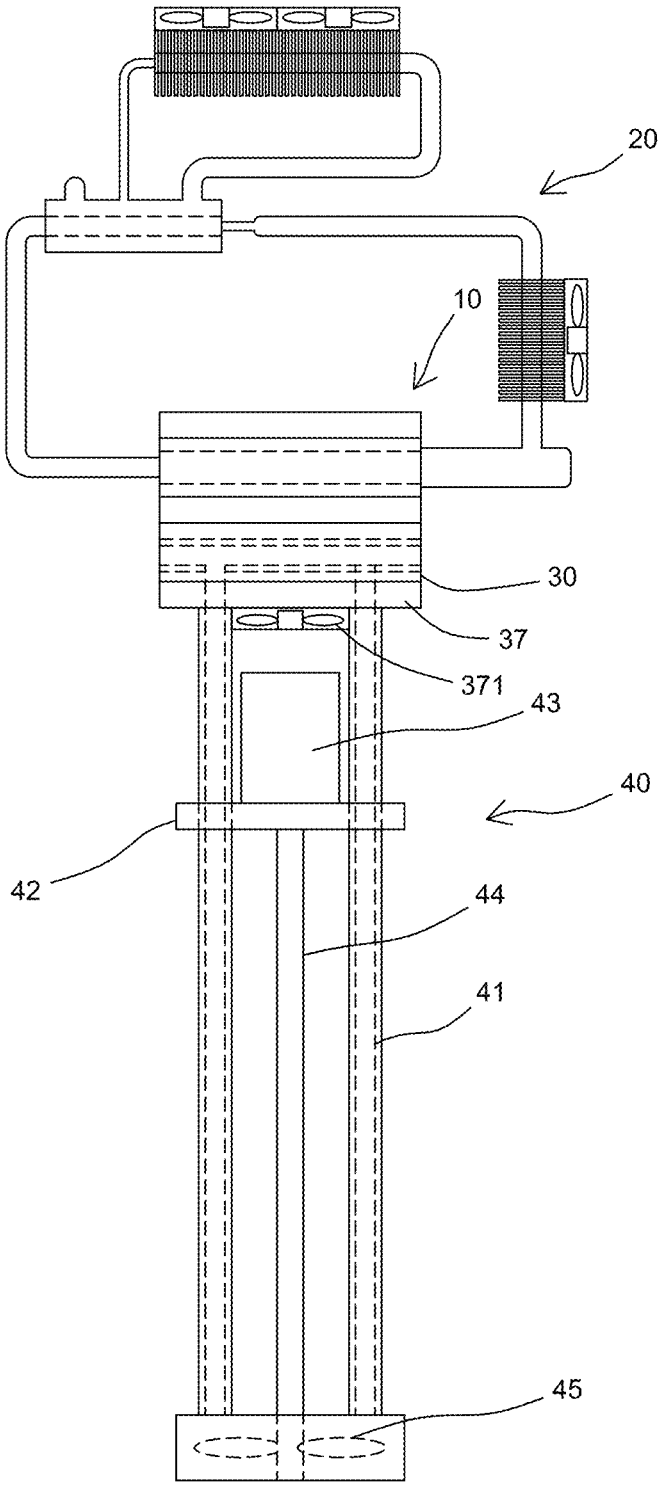
FIG. 8 shows a planar view of a fourth embodiment of the present invention.

A fourth embodiment is shown in FIG. 8, wherein the object of application 40 is implemented as that a lower side of the condensing block 30 is provided with the third cooling fin 37, a lower side of the third cooling fin 37 is provided with the fans 371, a lower side of the condensing block 30 is further connected with plural upright heat pipes 41, a frame plate 42 is disposed above the heat pipes 41 and is provided with a motor 43, the motor 43 is provided with a transmission shaft 44, and the transmission shaft 44 drives a mixing blade 45. The fourth embodiment can be applied to the cooling of a mixer. On the other hand, the heat sink 10 and the amplifying loop heat pipe 20 are the same as that in the first embodiment.

Figure 9:
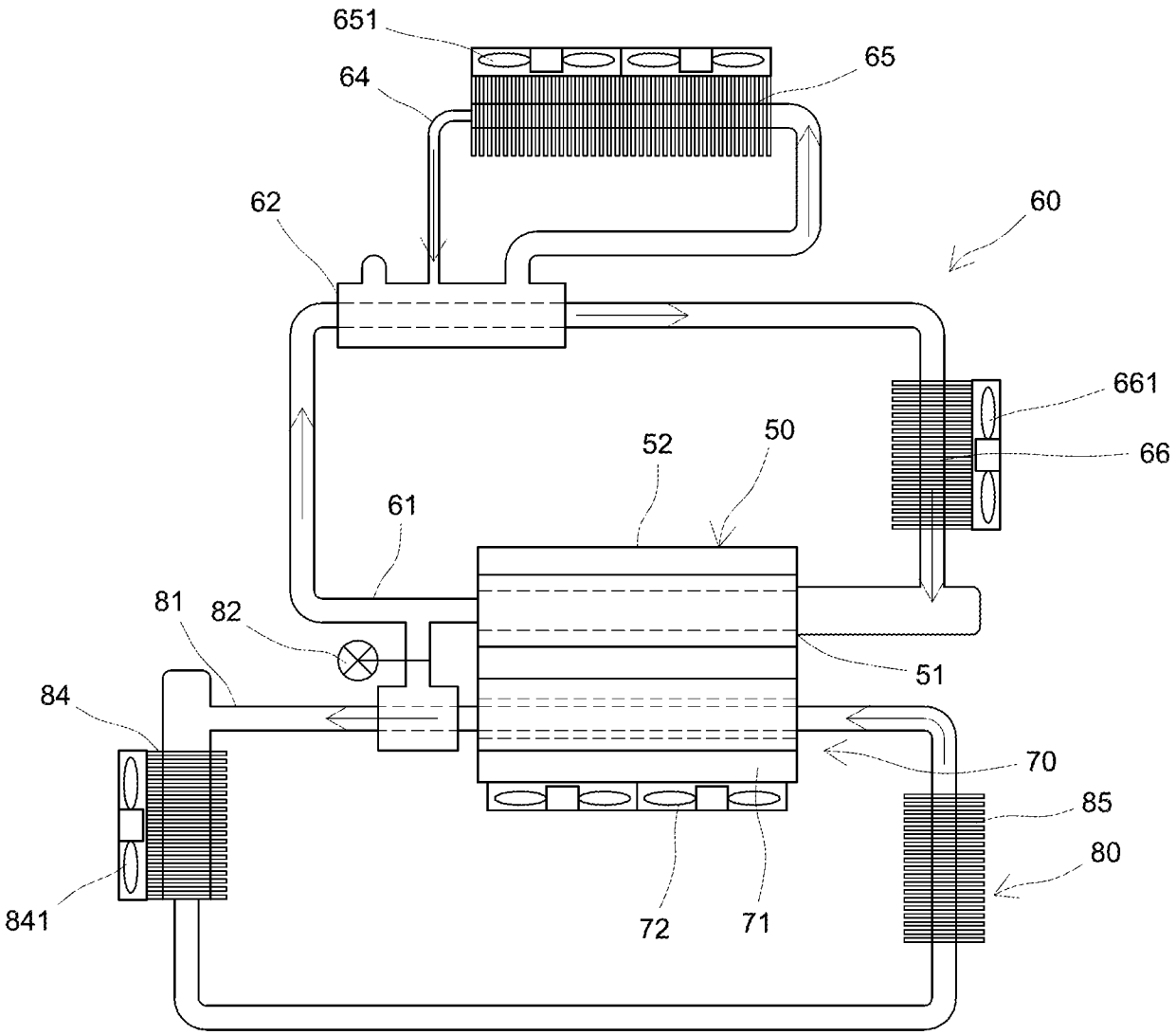
FIG. 9 shows a planar view of a fifth embodiment of the present invention.

A fifth embodiment is shown in FIG. 9, comprising a heat sink 50, an amplifying loop heat pipe 60, a condensing block 70 and an object of application 80. The heat sink 50 is provided with two face-to-face hot-surface heat sink blocks 51, and top ends of the two hot-surface heat sink blocks 51 are provided with a heat insulating cover 52. A hot-surface loop heat pipe 61 affixes itself to the hot-surface heat sink blocks 51 via penetration, and a concaved embedding space (not shown in the drawing, and same as that in the first embodiment) is formed between the two hot-surface heat sink blocks 51. Two sides in the embedding space are provided respectively with one refrigeration chip, the refrigeration chip is provided with a refrigeration surface and a heat dissipation surface (not shown in the drawing, and same as that in the first embodiment), and the heat dissipation surface is attached on an inner surface of the hot-surface heat sink block 51. The condensing block 70 is disposed in the embedding space. A cold-surface loop heat pipe 81 affixes itself to the condensing block 70 via penetration. The refrigeration surface is attached on an outer surface of the condensing block 70, and the amplifying loop heat pipe 60 is provided with a hot-surface loop heat pipe 61, a first evaporating pipe 62, a secondary loop heat pipe 64, a first cooling fin 65 and a second cooling fin 66. The hot-surface loop heat pipe 61 crosses the hot-surface heat sink blocks 51, and then penetrates into the first evaporating pipe 62 and the second cooling fin 66. The first evaporating pipe 62 provides for introduction of an outlet of the secondary loop heat pipe 64. An upper side of the first cooling fin 65 is provided with fans 651, and a side of the second cooling fin 66 is provided with fans 661, as well. The object of application 80 is implemented as that an end of the cold-surface loop heat pipe 81 is provided with a solenoid valve switch 82 which is connected with the hot-surface loop heat pipe 61, the other end of the cold-surface loop heat pipe 81 penetrates into the condensing block 70, the cold-surface loop heat pipe 81 is provided with a sixth cooling fin 84, fans 841 and a seventh cooling fin 85, a lower side of the condensing block 70 is provided with a third cooling fin 71, and a lower side of the third cooling fin 71 is provided with fans 72.

In the fifth embodiment, the refrigeration surface of the refrigeration chip is attached on the condensing block 70, and then the condensing block 70 is disposed in the embedding space of the hot-surface heat sink blocks 51 for positioning. The heat source resulted from the heat dissipation surface of the refrigeration chip passes through the hot-surface heat sink blocks 51 to the hot-surface loop heat pipe 61, goes through the first evaporating pipe 62 (as shown in the arrow on FIG. 9) to the second cooling fin 66, and then circulates into the hot-surface heat sink blocks 51. When passing through the first evaporating pipe 62, a tail end of the working fluid in the secondary loop heat pipe 64 of the first evaporating pipe 62 circulates to the first cooling fin 65 and then to the outlet of the secondary loop heat pipe 64, followed by re-entering into the first evaporating pipe 62. Accordingly, the working fluid circulates repeatedly, decreasing temperature of the heat source resulted from the heat dissipation surface of the refrigeration chip through the first evaporating pipe 62, the first cooling fin 65 and the second cooling fin 66, and then dissipating a heat flow quickly and effectively through the fans 651, 661 continuously. On the other hand, the cold source resulted from the refrigeration surface of the refrigeration chip passes through the condensing block 70 to the cold-surface loop heat pipe 81, goes through the sixth cooling fin 84 and the seventh cooling fin 85, and then circulates to the condensing block 70. Accordingly, the working fluid circulates repeatedly, conducting the cold source resulted from the refrigeration surface of the refrigeration chip through the sixth cooling fin 84, the seventh cooling fin 85 and the third cooling fin 71, and dissipating the cold source for refrigeration by the fans 72, 841. If an interior of the cold-surface loop heat pipe 81 is frozen that the working fluid cannot flow through, then the solenoid valve switch 82 is turned on, introducing the heat source of the hot-surface loop heat pipe 61 into the cold-surface loop heat pipe 81 to defreeze the frozen cold-surface loop heat pipe 81. The solenoid valve switch 82 is turned off when the cold-surface loop heat pipe 81 is clear.

Figure 10:
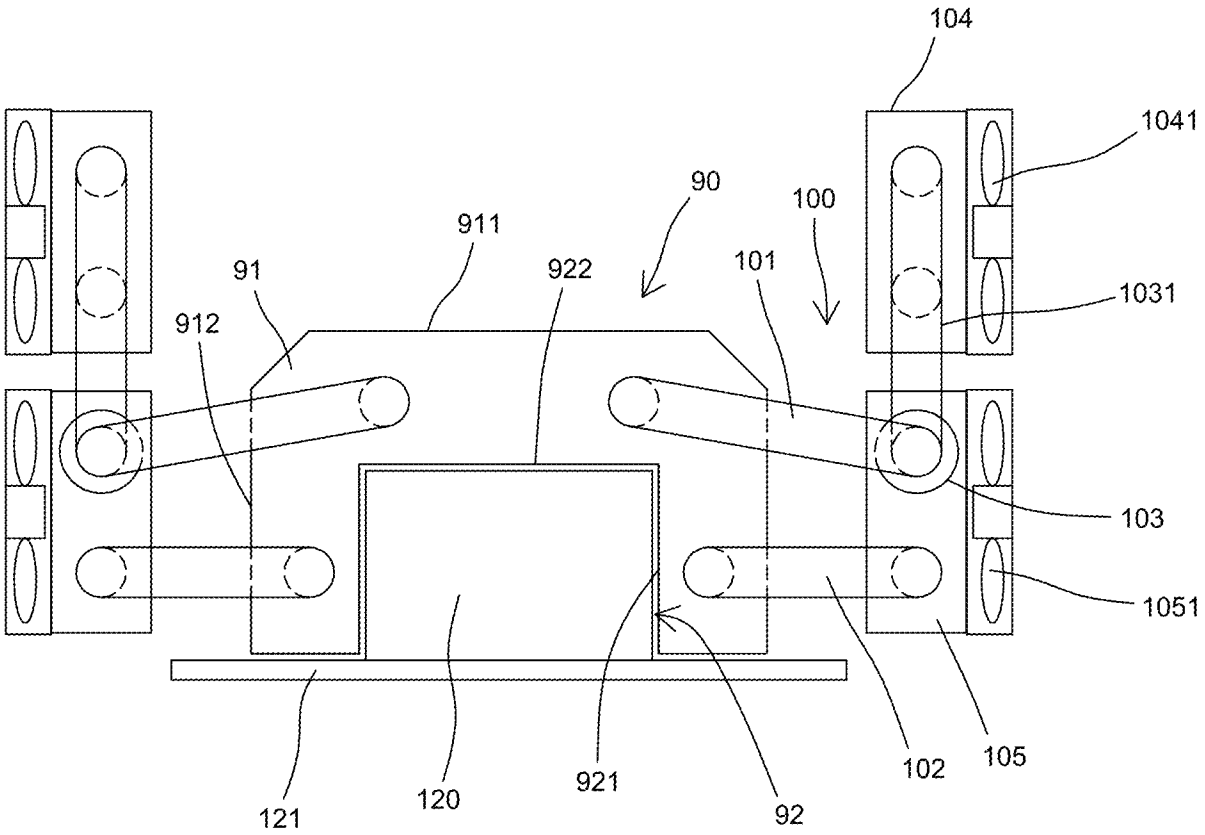
FIG. 10 shows a planar view of the heat sink and an amplifying loop heat pipe, according to a sixth embodiment of the present invention.
Figure 11:
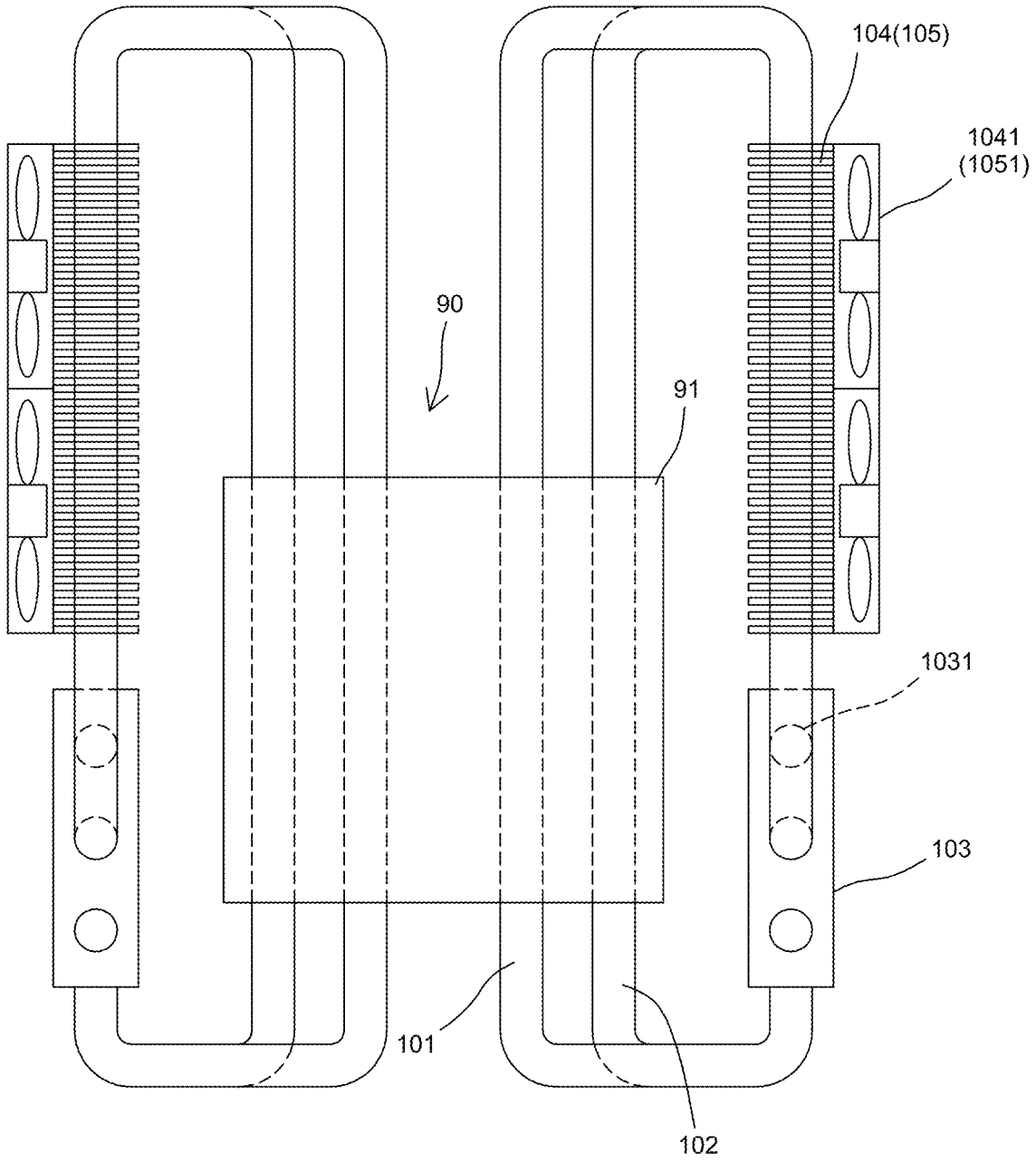
FIG. 11 shows a top planar view of the heat sink and the amplifying loop heat pipe, according to the sixth embodiment of the present invention.

A sixth embodiment is shown in FIG. 10 and FIG. 11, comprising a heat sink 90 and an amplifying loop heat pipe 100. The heat sink 90 is provided with an inverted-U-shaped hot-surface heat sink block 91 which includes a top block 911 and two side blocks 912. The two upper hot-surface loop heat pipes 101 affix themselves to the top block 911 via penetration. A lower hot-surface loop heat pipe 102 affixes itself to each of the two side blocks 912 via penetration. A concaved embedding space 92 is formed between the two side blocks 912, and an interior of the embedding space 92 is provided with two inner surfaces 921 and an inner top surface 922. An integrated circuit object 120 is disposed in the embedding space 92 and can be a CPU (Central Processing Unit) or GPU (Graphics Processing Unit). Each of two sides of the amplifying loop heat pipe 100 is provided with the upper hot-surface loop heat pipe 101, the lower hot-surface loop heat pipe 102, a secondary loop heat pipe 1031, an evaporating pipe 103, an upper cooling fin 104, a lower cooling fin 105, an upper fan 1041, and a lower fan 1051. The upper hot-surface loop heat pipes 101 cross the top block 911 of the hot-surface heat sink block 91, and then penetrate into an upper side of the evaporating pipe 103 and the lower cooling fin 105 to form a loop. One section of the upper hot-surface loop heat pipe 101 is enclosed by the evaporating pipe 103 which is connected with the secondary loop heat pipe 1031. The secondary loop heat pipe 1031 penetrates into the upper cooling fin 104, and the lower hot-surface loop heat pipe 102 crosses the side blocks 912 of the hot-surface heat sink block 91, followed by penetrating into a lower side of the lower cooling fin 105 to form a loop.

Currently, computers, cell phones and other electronic products are all a single-surface heating element. However, the future integrated circuit object 120 (GPU) is developed toward a 2.5D and 3D heat source, i.e., heat is generated from a top surface, a left surface, a right surface, a front surface and a rear surface. A bottom of the integrated circuit object 120 in the sixth embodiment can be a motherboard 121, and a top surface and two side surfaces (heat dissipation surfaces) of the integrated circuit object 120 are attached on the inner top surface 922 and two inner surfaces 921 of the embedding space 92 of the hot-surface heat sink block 91 for positioning. The heat source generated from the heat dissipation surface (top surface) of the integrated circuit object 120 passes through the top block 911 of the hot-surface heat sink block 91 to the upper hot-surface loop heat pipe 101, and then is cooled down through the evaporating pipes 103 on the left side and the right side, respectively. Next, the heat source passes through the lower cooling fin 105 and circulates into the top block 911 of the hot-surface heat sink block 91. After the working fluid in the secondary loop heat pipe 1031 of the evaporating pipe 103 vaporizes, the heat source circulates to the upper cooling fin 104 by one turn and circulates into the evaporating pipe 103. Accordingly, the heat source circulates repeatedly. On the other hand, the heat source generated from the heat dissipation surfaces (two side surfaces) of the integrated circuit object 120 passes through two side blocks 912 of the hot-surface heat sink block 91 to the lower hot-surface loop heat pipe 102, and then goes through the lower cooling fin 105 and circulates to two side blocks 912 of the hot-surface heat sink block 91. Accordingly, the heat source circulates repeatedly, quickly and effectively dissipating the heat source generated from the heat dissipation surfaces of the integrated circuit object 120. In addition to the integrated circuit object 120, three refrigeration chips can be also attached on two inner surfaces 921 and the inner top surface 922 of the embedding space 92 to achieve the heat dissipation effect.

Figure 12:
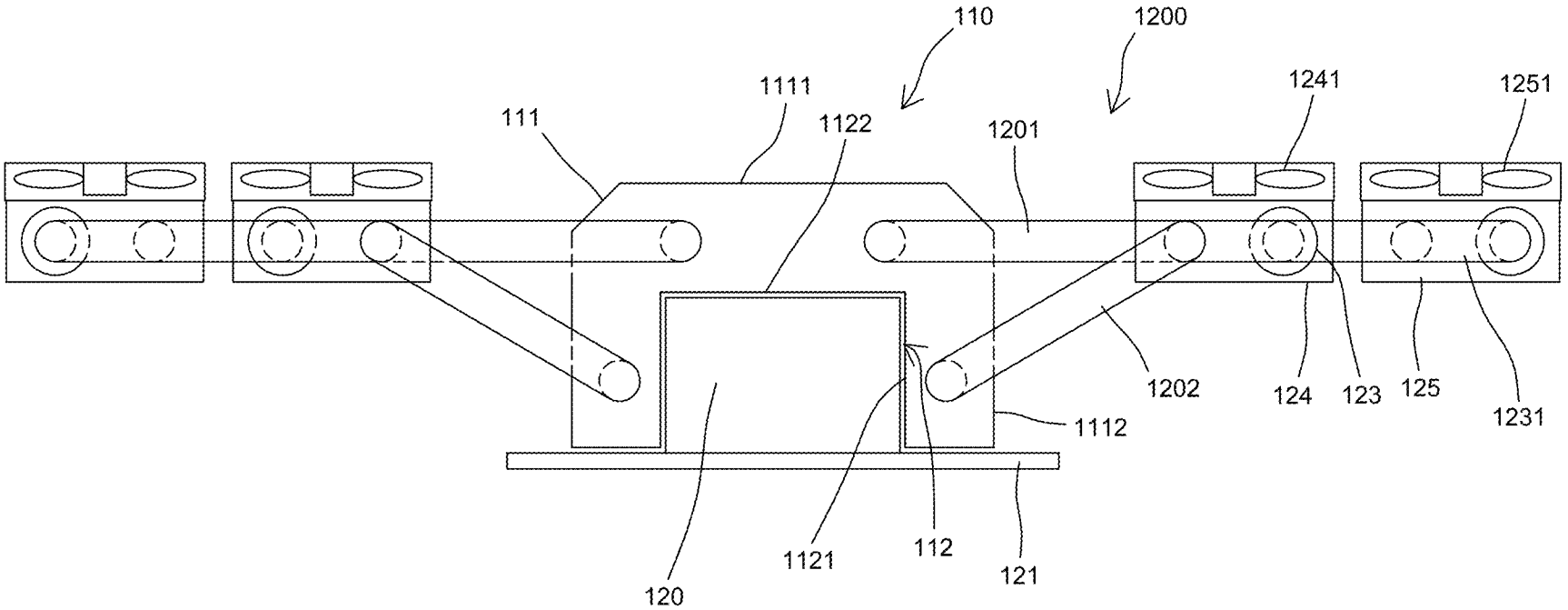
FIG. 12 shows a planar view of the heat sink and the amplifying loop heat pipe, according to a seventh embodiment of the present invention.
Figure 13:
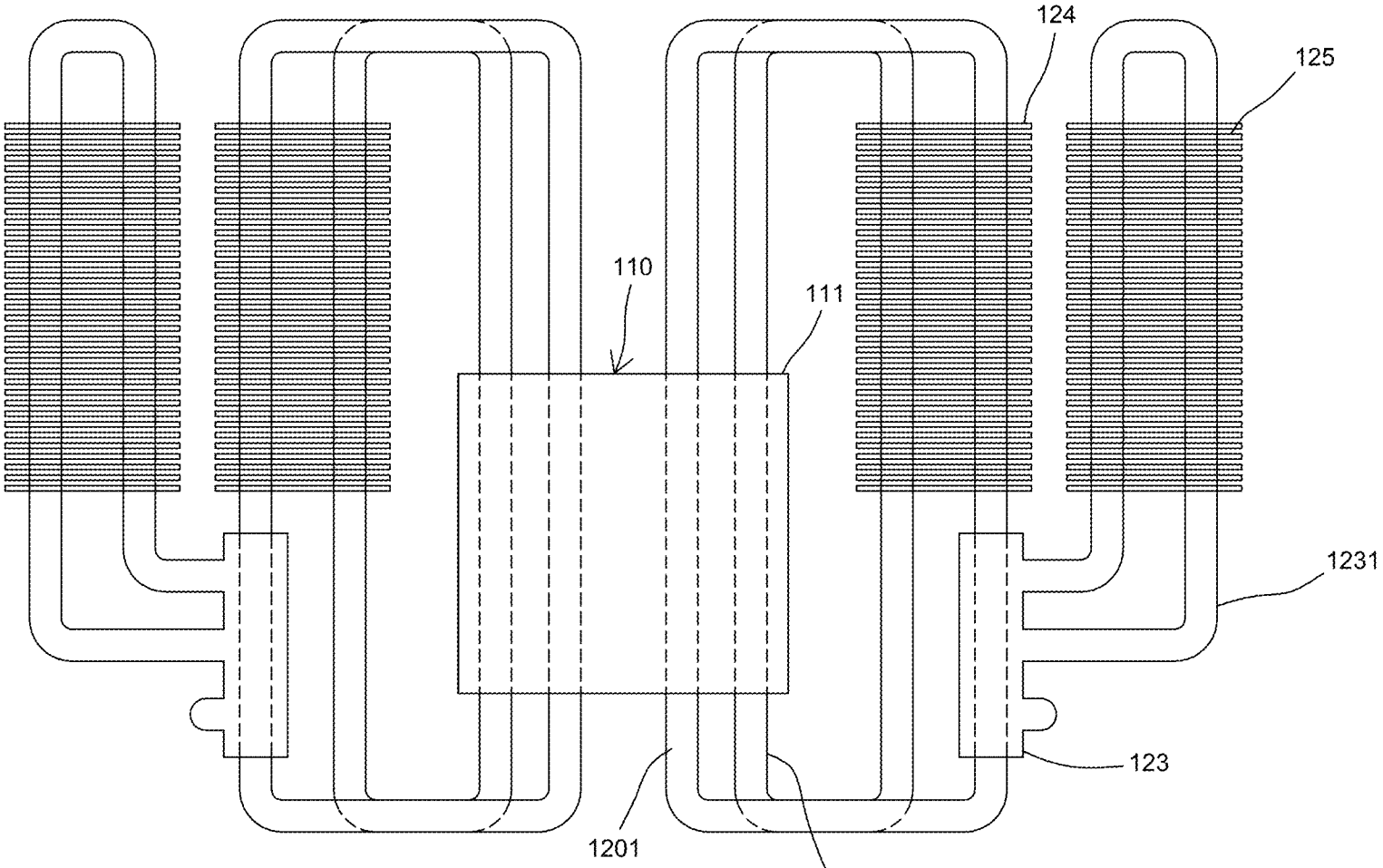
FIG. 13 shows a top planar view of the heat sink and the amplifying loop heat pipe, according to the seventh embodiment of the present invention.

A seventh embodiment is shown in FIG. 12 and FIG. 13, comprising a heat sink 110 and an amplifying loop heat pipe 1200. The heat sink 110 is a hot-surface heat sink block 111 which includes a top block 1111 and two side blocks 1112. The two upper hot-surface loop heat pipes 1201 affix themselves to the top block 1111 via penetration. A lower hot-surface loop heat pipe 1202 affixes itself to the two side blocks 1112 via penetration. A concaved embedding space 112 is formed between two side blocks 1112, and an interior of the embedding space 112 is provided with plural inner surfaces 1121 (two inner surfaces or four inner surfaces) and an inner top surface 1122. An integrated circuit object 120 is disposed in the embedding space 112 and can be a CPU or GPU. Each of the two sides of the amplifying loop heat pipe 1200 is provided with an upper hot-surface loop heat pipe 1201, a lower hot-surface loop heat pipe 1202, a secondary loop heat pipe 1231, an evaporating pipe 123, an inner cooling fin 124, an outer cooling fin 125, an inner fan 1241, and an outer fan 1251. The upper hot-surface loop heat pipes 1201 cross the top block 1111 of the hot-surface heat sink block 111, and then penetrate into the evaporating pipe 123 and the inner cooling fin 124 to form a loop. One section of the upper hot-surface loop heat pipe 1201 is enclosed by the evaporating pipe 123 which is connected with the secondary loop heat pipe 1231. The secondary loop heat pipe 1231 penetrates into the outer cooling fin 125, and the lower hot-surface loop heat pipe 1202 crosses the side blocks 1112 of the hot-surface heat sink block 111, followed by penetrating into the inner cooling fin 124 to form a loop.

In the seventh embodiment, a bottom of the integrated circuit object 120 can be a motherboard 121, and a top surface and two side surfaces (heat dissipation surfaces) of the integrated circuit object 120 are attached on the inner top surface 1122 and two inner surfaces 1121 of the embedding space 112 of the hot-surface heat sink block 111 for positioning. The heat source generated from the heat dissipation surface (top surface) of the integrated circuit object 120 passes through the top block 1111 of the hot-surface heat sink block 111 to the upper hot-surface loop heat pipe 1201, and then is cooled down through the evaporating pipes 123 on the left side and the right side, respectively. Next, the heat energy of the heat source transfers through the inner cooling fin 124 and circulates into the top block 1111 of the hot-surface heat sink block 111. After the working fluid in the secondary loop heat pipe 1231 of the evaporating pipe 123 vaporizes, the heat source circulates to the outer cooling fin 125 by one turn and circulates into the evaporating pipe 123. Accordingly, the heat source circulates. On the other hand, the heat source generated from the heat dissipation surfaces (two side surfaces) of the integrated circuit object 120 passes through two side blocks 1112 of the hot-surface heat sink block 111 to the lower hot-surface loop heat pipe 1202, and then passes through the inner cooling fin 124 and circulates to two side blocks 1112 of the hot-surface heat sink block 111. Accordingly, the working fluid circulates repeatedly, quickly and effectively dissipating the heat source generated from the heat dissipation surfaces of the integrated circuit object 120. If there are five inner surfaces in the embedding space 112 of the hot-surface heat sink block 111 (i.e., a rectangular embedding space), then the seventh embodiment can be applied to a 2.5D GPU (i.e., dissipating heat from 3 surfaces, including a top surface, a left surface and a right surface) or a 3D GPU (i.e., dissipating heat from 5 surfaces, including a top surface, a left surface, a right surface, a front surface and a rear surface). In addition to the integrated circuit object 120, three refrigeration chips can be also attached on the inner top surface 1122 and two inner surfaces 1121 in the embedding space 112 to achieve the heat dissipation effect.

It is of course to be understood that the embodiments described herein is merely illustrative of the principles of the invention and that a wide variety of modifications thereto may be effected by persons skilled in the art without departing from the spirit and scope of the invention as set forth in the following

What is claimed is:

1. An intensified cassette-type heat dissipation module, comprising a heat sink, which is provided with two opposite hot-surface heat sink blocks, top ends of the two hot-surface heat sink blocks are provided with a heat insulating cover, wherein a hot-surface loop heat pipe affixes itself to each of the hot-surface heat sink blocks via penetration, a concaved embedding space is formed between the two hot-surface heat sink blocks and the heat insulating cover, two sides in the embedding space are provided respectively with plural refrigeration chips, wherein each of the refrigeration chips is provided with a refrigeration surface and a heat dissipation surface, and the heat dissipation surface is attached on an inner surface of the hot-surface heat sink block;

an amplifying loop heat pipe comprised of the hot-surface loop heat pipe, a first evaporating pipe, a secondary loop heat pipe, a first cooling fin and a second cooling fin, the hot-surface loop heat pipe crosses the hot-surface heat sink block and then penetrates into the first evaporating pipe and the second cooling fin, the first evaporating pipe connects to two ends of the secondary loop heat pipe, an upper side of the first cooling fin is provided with fans, and a side of the second cooling fin is provided with fans;

a condensing block, which is disposed in the embedding space along with the plural refrigeration chips, the refrigeration surface of the refrigeration chip is attached on an outer surface of the condensing block, and a cold-surface loop heat pipe affixes itself to the condensing block via penetration; and wherein the refrigeration chips transmit energy to the condensing block and the cold-surface loop heat pipe supplies the energy.

2. The intensified cassette-type heat dissipation module, according to claim 1, wherein the cold-surface loop heat pipe crosses a fourth cooling fin, a fifth cooling fin and a refrigerant tube, a lower side of the fifth cooling is provided with fans, a lower side of the condensing block is provided with a third cooling fin, and a lower side of the third cooling fin is provided with fans.

3. The intensified cassette-type heat dissipation module, according to claim 1, wherein a lower side of the condensing block is provided with a third cooling fin, a lower side of the third cooling fin is provided with fans, a lower side of the condensing block is connected with plural upright heat pipes, a frame plate is disposed above the heat pipes, the frame plate is provided with a motor, the motor is provided with a transmission shaft, and the transmission shaft drives a mixing blade.

4. The intensified cassette-type heat dissipation module, according to claim 1, further comprising two sets of hot-surface loop heat pipes, the two hot-surface loop heat pipes are independent of each other without being interconnected, and the cold-surface loop heat pipe is a single pipe unit.

5. The intensified cassette-type heat dissipation module, according to claim 1, further comprising two hot-surface loop heat pipes in the heat sink, tail ends of the two hot-surface loop heat pipes are connected together, and the cold-surface loop heat pipe is a single pipe unit.

6. The intensified cassette-type heat dissipation module, according to claim 1, further comprising two sets of hot-surface loop heat pipes and two sets of cold-surface loop heat pipes.

7. The intensified cassette-type heat dissipation module, according to claim 1, wherein an end of the cold-surface loop heat pipe is provided with a solenoid valve switch which is connected with the hot-surface loop heat pipe, the other end of the cold-surface loop heat pipe penetrates into the condensing block, the cold-surface loop heat pipe is provided with a sixth cooling fin and fans, a lower side of the condensing block is provided with a third cooling fin, and a lower side of the third cooling is provided with fans.

8. An intensified cassette-type heat dissipation module, comprising a heat sink, provided with an inverted-U-shaped hot-surface heat sink block, the hot-surface heat sink block is provided with a top block and two side blocks, two upper hot-surface loop heat pipes affix themselves to the top block via penetration, a lower hot-surface loop heat pipe affix itself to each of the two side blocks via penetration, a concaved embedding space is formed between two side blocks, an interior of the embedding space is provided with two inner surfaces and an inner top surface, and an integrated circuit object is disposed in the embedding space; and an amplifying loop heat pipe, each of two sides of which is provided with the upper hot-surface loop heat pipe, the lower hot-surface loop heat pipe, a secondary loop heat pipe, an evaporating pipe, an upper cooling fin, a lower cooling fin, an upper fan and a lower fan, the upper hot-surface loop heat pipe crosses the top block of the hot-surface heat sink block and then penetrates into an upper side of the evaporating pipe and the lower cooling fin to form a loop, one section of the upper hot-surface loop heat pipe is enclosed by the evaporating pipe, the evaporating pipe is connected with the secondary loop heat pipe, the secondary loop heat pipe penetrates into the upper cooling fin, and the lower hot-surface loop heat pipe crosses the side blocks of the hot-surface heat sink block and then penetrates into a lower side of the lower cooling fin to form a loop.

9. An intensified cassette-type heat dissipation module, comprising a heat sink, which is a hot-surface heat sink block, the hot-surface heat sink block is provided with a top block and two side blocks, two upper hot-surface loop heat pipes affix themselves to the top block via penetration, a lower hot-surface loop heat pipe affixes itself to each of the two side blocks via penetration, a concaved embedding space is formed between the two side blocks, an interior of the embedding space is provided with plural inner surfaces and an inner top surface, and an integrated circuit object is disposed in the embedding space; and an amplifying loop heat pipe, each of two sides of which is provided with the upper hot-surface loop heat pipe, the lower hot-surface loop heat pipe, a secondary loop heat pipe, an evaporating pipe, an inner cooling fin, an outer cooling fin, an inner fan and an outer fan, the upper hot-surface loop heat pipe crosses the top block of the hot-surface heat sink block and then penetrates into the evaporating pipe and the inner cooling fin to form a loop, one section of the upper hot-surface loop heat pipe is enclosed by the evaporating pipe, the evaporating pipe is connected with the secondary loop heat pipe, the secondary loop heat pipe penetrates into the outer cooling fin, and the lower hot-surface loop heat pipe crosses the side blocks of the hot-surface heat sink block and then penetrates into the inner cooling fin to form a loop.

10. The intensified cassette-type heat dissipation module, according to claim 8, wherein the integrated circuit object is a central processing unit, and a bottom of the integrated circuit object is provided with a motherboard.

11. The intensified cassette-type heat dissipation module, according to claim 9, wherein the integrated circuit object is a central processing unit, and a bottom of the integrated circuit object is provided with a motherboard.

* * * * *